US006386160B1

(12) United States Patent
Meneely et al.

(10) Patent No.: US 6,386,160 B1
(45) Date of Patent: May 14, 2002

(54) VALVE CONTROL APPARATUS WITH RESET

(75) Inventors: Vincent A. Meneely, Langley (CA); Robert B. Price, Manchester, CT (US)

(73) Assignee: Jenara Enterprises, Ltd. (CA)

( * ) Notice: Subject to any disclaimer, the term of this patent is extended or adjusted under 35 U.S.C. 154(b) by 0 days.

(21) Appl. No.: 09/469,303

(22) Filed: Dec. 22, 1999

(51) Int. Cl.[7] ..... F01L 1/34

(52) U.S. Cl. ..... 123/90.16; 123/90.17; 123/90.12

(58) Field of Search ..... 123/90.12, 90.16, 123/90.17, 90.46, 90.55, 90.63, 320, 321, 322

(56) References Cited

U.S. PATENT DOCUMENTS

| | | | | | |
|---|---|---|---|---|---|
| 3,786,792 | A | | 1/1974 | Pelizzoni et al. | 123/97 B |
| 3,809,033 | A | | 5/1974 | Cartledge | 123/90.46 |
| 4,164,917 | A | | 8/1979 | Glasson | 123/97 |
| 4,473,047 | A | * | 9/1984 | Jakuba et al. | 123/90.16 |
| 4,697,558 | A | * | 10/1987 | Meneely | 123/321 |
| 4,793,307 | A | * | 12/1988 | Quenneville et al. | 123/90.12 |
| 4,836,162 | A | * | 6/1989 | Melde-Tuczai et al. | 123/321 |
| 4,848,289 | A | * | 7/1989 | Meneely | 123/320 |
| 5,036,810 | A | * | 8/1991 | Meneely | 123/321 |
| 5,105,782 | A | * | 4/1992 | Meneely | 123/321 |
| 5,146,890 | A | | 9/1992 | Gobert et al. | 123/321 |
| 5,193,497 | A | | 3/1993 | Hakansson | 123/90.16 |
| 5,564,385 | A | | 10/1996 | Hakansson | 123/321 |
| 5,609,133 | A | | 3/1997 | Hakansson | 123/321 |
| 5,645,031 | A | * | 7/1997 | Meneely | 123/322 |
| 5,680,841 | A | * | 10/1997 | Hu | 123/322 |
| 5,758,620 | A | | 6/1998 | Warner | 123/321 |
| 5,787,858 | A | * | 8/1998 | Meneely | 123/321 |
| 5,794,589 | A | | 8/1998 | Hakansson | 123/321 |
| 5,829,397 | A | * | 11/1998 | Vorih et al. | 123/90.12 |
| 5,839,453 | A | * | 11/1998 | Hu | 123/322 |
| 5,890,469 | A | | 4/1999 | Hakansson | 123/321 |
| 6,125,828 | A | * | 10/2000 | Hu | 123/322 |

* cited by examiner

*Primary Examiner*—Teresa Walberg
*Assistant Examiner*—Fadi H. Dahbour
(74) *Attorney, Agent, or Firm*—Liniak, Berenato, Longacre & White, LLC

(57) ABSTRACT

A valve control apparatus is provided for an internal combustion engine having a valve and a camshaft. The camshaft has an axis of rotation, a first raised portion and a second raised portion adjacent to the first raised portion. The second raised portion is angularly spaced-apart about the axis from the first raised portion. The apparatus includes a follower operatively engagable with the camshaft and the valve. The follower has a first operational mode where the first raised portion operatively engages the follower on each revolution of the camshaft to open the valve a first time on each revolution. There is a mechanism for selectively putting the follower in a second operational mode where the second raised portion operatively engages the follower to open the valve a second time on each revolution of the camshaft. The mechanism puts the follower in the second operational mode on each revolution of the camshaft before the second raised portion is fully aligned with the follower. The mechanism has a device which returns the follower to the first mode after the valve is opened by the second raised portion and before the first raised portion fully operatively engages the follower. Maximum opening and closing of the valve by the first raised portion is thereby unaffected when the mechanism selectively puts the follower in the second operational mode. The device is triggered by the camshaft or by relative movement between a portion of the rocker arm assembly and the valve.

26 Claims, 16 Drawing Sheets

VALVE CONTROL APPARATUS WITH RESET

BACKGROUND OF THE INVENTION

This invention relates to valve control apparatuses and, in particular, to valve control apparatuses for diesel engine compression release brakes.

Compression release brakes are used to slow diesel powered vehicles such as large tractor trailer units. These brakes work by releasing compressed gases from each cylinder near top dead center of each compression stroke. This removes the rebound effect whereby the compressed gases would tend to drive the piston downwardly and thereby counter the braking effect otherwise created when the pistons compress gases during the compression stroke. Engine brakes are normally operated when a vehicle is coasting downhill and the fuel supply to the engine has been cut off. Wear on the wheel brakes is reduced since an engine brake significantly reduces the braking contribution required from the wheel brakes.

At least one exhaust valve on each cylinder is cracked open just before top dead center of each compression stroke when the brake is operational. Some mechanism must be provided, therefore, to open each exhaust valve twice during each engine cycle. The normal exhaust valve opening occurs during the exhaust stroke when the piston is moving upwardly towards the cylinder head. The second exhaust valve opening occurs during braking operation near the top dead center position at the end of the compression stroke. Various mechanisms have been devised to selectively crack open each exhaust valve the second time during each engine cycle. In many engines, for example, a fuel injector mechanism is used to crack open each exhaust valve at the required time. However such a mechanism is not available, nor suitable for all types of engines. Accordingly, alternative mechanisms have been devised.

One problem with such prior art engine brakes is that the normal operation of the exhaust valve is affected during brake operation. Clearance between the cam follower and camshaft is effectively reduced during brake operation. This means that the first lobe on the camshaft opens the exhaust valve further than normal for the exhaust stroke during exhaust brake operation. In some cases it is necessary to provide recesses in the pistons so that the exhaust valves do not strike the pistons when the brake is operational. These recesses, and the abnormally extended exhaust valves, interfere with optimal engine design from the point of view of other considerations such as emission controls.

Another problem with such prior art engine brakes is that the exhaust valve overlap at top dead center may be increased during brake operation. This means that exhaust gas energy is lost from the exhaust manifold to the inlet stroke of the cylinder. Recovering the lost energy would be beneficial in order to drive the turbocharger to supercharge the compression stroke.

It is an object of the invention to provide an improved valve control apparatus which overcomes the disadvantages associated with the prior art.

It is also an object of the invention to provide an improved valve control apparatus which allows a camshaft to selectively open each exhaust valve near top dead center of each compression stroke, for engine braking purposes, without interfering with normal maximum lift and closing of each exhaust valve on each exhaust stroke.

Is a further object of the invention to provide an improved valve control apparatus which is rugged and economical in construction and reliable during operation.

SUMMARY OF THE INVENTION

There is provided, according to one aspect of the invention, a valve control apparatus for an internal combustion engine having a valve and a camshaft. The camshaft has an axis of rotation, a first raised portion and a second lobe. The second raised portion is angularly spaced-apart about the axis from the first raised portion. The first raised portion extends further from the axis of rotation than the second raised portion. The apparatus includes a follower which is operatively engagable with the camshaft and the valve. The follower is positioned to operatively engage the first raised portion on each revolution of the camshaft and to open the valve a first time on each revolution of the camshaft. There is a mechanism for selectively changing operative clearance between the follower and at least one of the camshaft and the valve. The mechanism selectively reduces the clearance on each revolution of the camshaft after the valve is opened by the first raised portion. The follower operatively engages the second raised portion and opens the valve a second time on each revolution of the camshaft when the clearance is so reduced. The mechanism has a device which increases the clearance on each revolution of the camshaft after the valve is opened the second time and before the valve is fully opened by the first raised portion again. The device may be triggered by the camshaft.

The follower may be a rocker arm assembly and alternatively the device may be triggered between relative movement between a portion of the rocker arm assembly and the valve of the engine.

There is provided, according to another aspect of the invention, an internal combustion apparatus which includes an engine having a plurality of cylinders. Each cylinder has a valve. There is a camshaft having an axis of rotation, a first raised portion and a second raised portion. The second raised portion is angularly spaced-apart about the axis from the first raised portion. A follower is operative engagable with the camshaft and with the valve of said each cylinder. The follower has a first operational mode where the first raised portion operatively engages the follower on each revolution of the camshaft to open the valve a first time and where the second raised portion operatively clears the follower on each revolution of the camshaft without actuating the valve. There is a mechanism for selectively putting the follower in a second operational mode where the second raised portion operatively engages the follower to open the valve a second time on each revolution of the camshaft. The mechanism puts the follower in the second operational mode on each revolution of the camshaft before the second raised portion is fully aligned with the follower. The mechanism has a device for returning the follower to the first operational mode after the valve is opened by the second raised portion and before the first raised portion fully operatively engages the follower. Maximum opening and normal closing of the valve by the first raised portion is unaffected when the mechanism selectively puts the follower in the second operational mode. The device may be triggered by the camshaft.

Alternatively, where the follower is a rocker arm assembly, the device may be triggered by relative movement between a portion of the rocker arm assembly and the valve.

There is provided, according to a further aspect of the invention a method of controlling valve actuation for an internal combustion engine having a valve and a camshaft. The method comprises the steps of providing a mechanism operatively connection the valve and the camshaft. Two raised portions are provided on the camshaft for the valve.

A first raised portion operatively engages the mechanism to open the valve a first time on each revolution of the camshaft. The mechanism is selectively adjusted a first time on each revolution of the camshaft after the first raised portion passes the mechanism so the mechanism engages a second said raised portion to open the valve a second time on each revolution of the camshaft. The mechanism is adjusted a second time on each revolution of the camshaft after the second raised portion opens the valve so the maximum opening and normal closing of the valve by the first raised portion is unaffected after the mechanism is selectively adjusted the second time. The mechanism may be adjusted the second time by a device which contacts the camshaft.

Alternatively, where the follower is a rocker arm assembly, the mechanism may be adjusted the second time by relative movement between a portion of the rocker arm assembly and the valve of the engine.

DETAILED DESCRIPTION OF THE PREFERRED EMBODIMENTS

Figure 1:
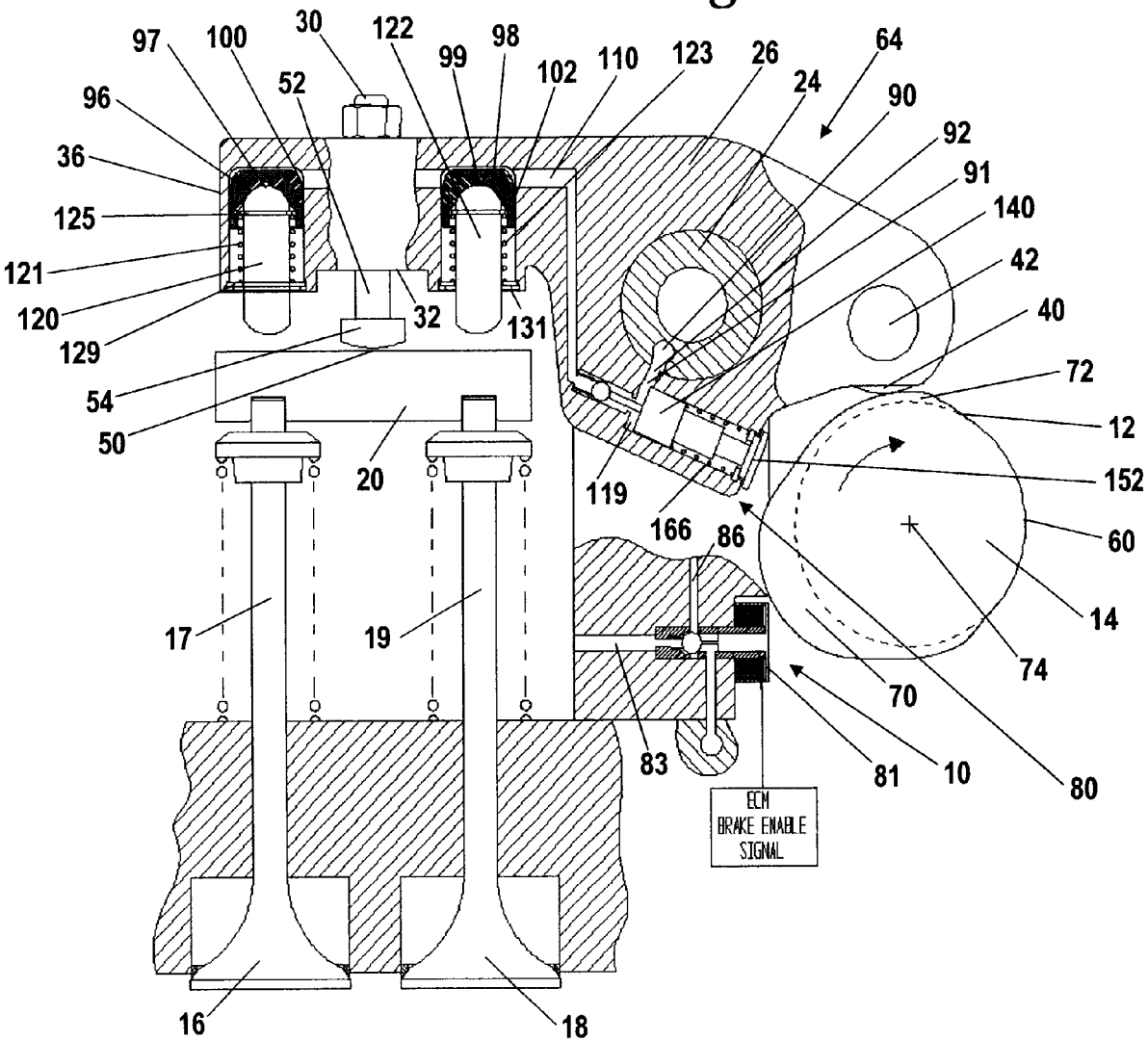
FIG. 1 is a fragmentary partly diagrammatic side view, partly in section, of a fragment of an engine with a valve control apparatus according to an embodiment of the invention, the apparatus being shown in a position where the rocker arm is on a second lobe of the camshaft and the compression release brake is non-operational.

Referring to the drawings, and first to FIG. 1, this shows a fragment of an internal combustion engine 10 which, in this embodiment, is a four stroke diesel engine although the invention is applicable to other types of engines. The engine is provided with a camshaft 12 represented by a single cam 14 in the drawings although there would be additional such cams in a typical engine. The cam 14 is used to open a pair of exhaust valves 16 and 18. The invention however is also useful for engines having other configurations of valves, such as a single exhaust valve per cylinder, and to other types of valves such as intake valves. The pair of exhaust valves are operatively interconnected by a crosshead 20. The crosshead rests on the exterior ends of the stems 17 and 19 of the valves.

Figure 2:
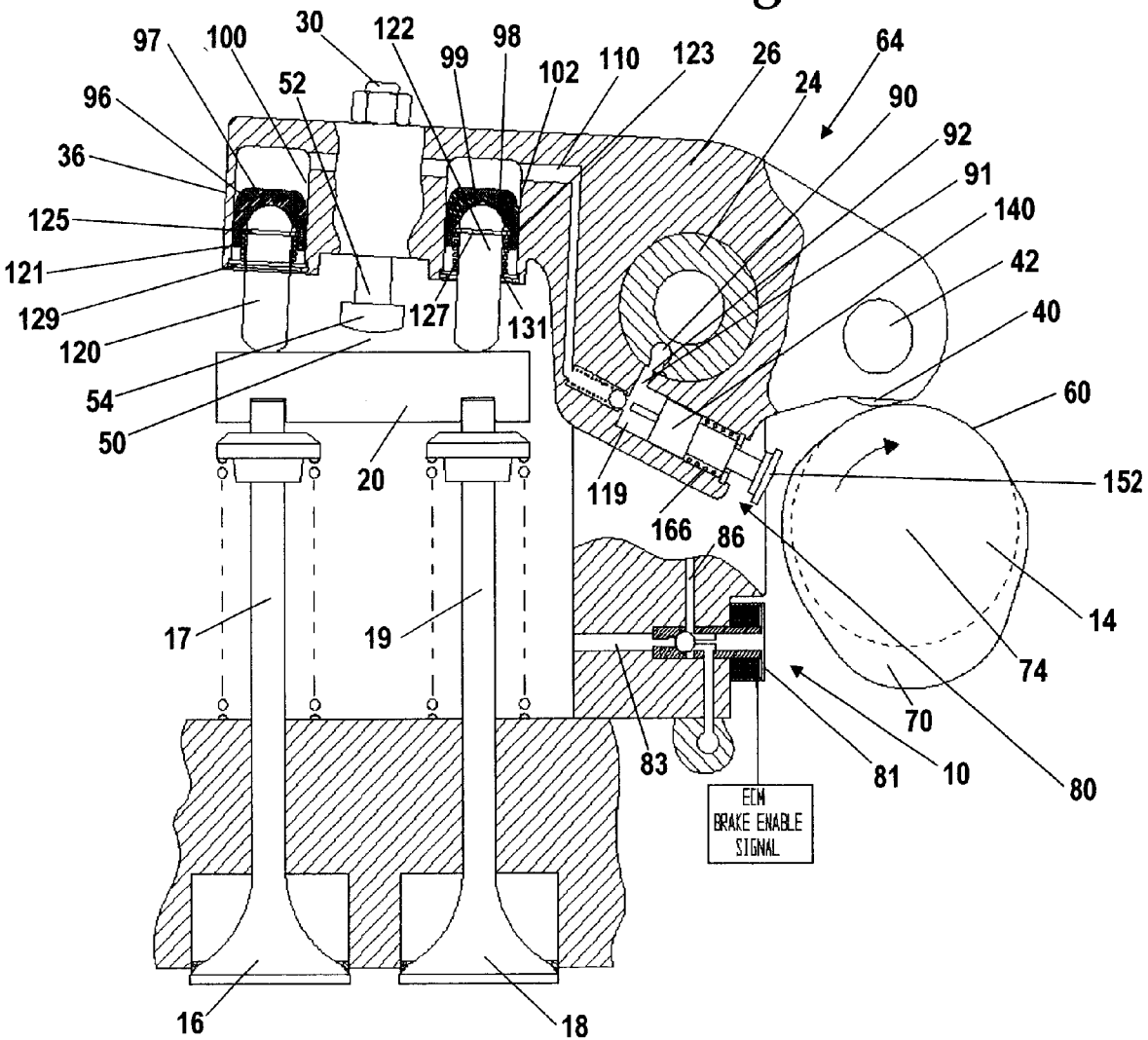
FIG. 2 is a view similar to FIG. 1 with the compression release brake operational and the rocker arm on roller of the dwell surface of the cam.

The engine has a rocker arm shaft 24 provided with a rocker arm 26. The rocker arm is provided with an adjustment screw 30 which is threadedly received in a bore 32 in the rocker arm adjacent end 36 thereof above the crosshead 20. The rocker arm has a roller 40 rotatable on a shaft 42 which contacts the cam 14. The screw 30 is adjusted so as to provide clearance between the follower and at least one of the camshaft and the valve. This clearance is typically represented by a gap 50 between member 54 on bottom of the adjustment screw 52 and crosshead 20. This gap exists when roller 40 is on sub-base circle 60 of the cam as shown in FIG. 2. As described thus far, the engine is conventional and therefore is not described in more detail.

Figure 4:
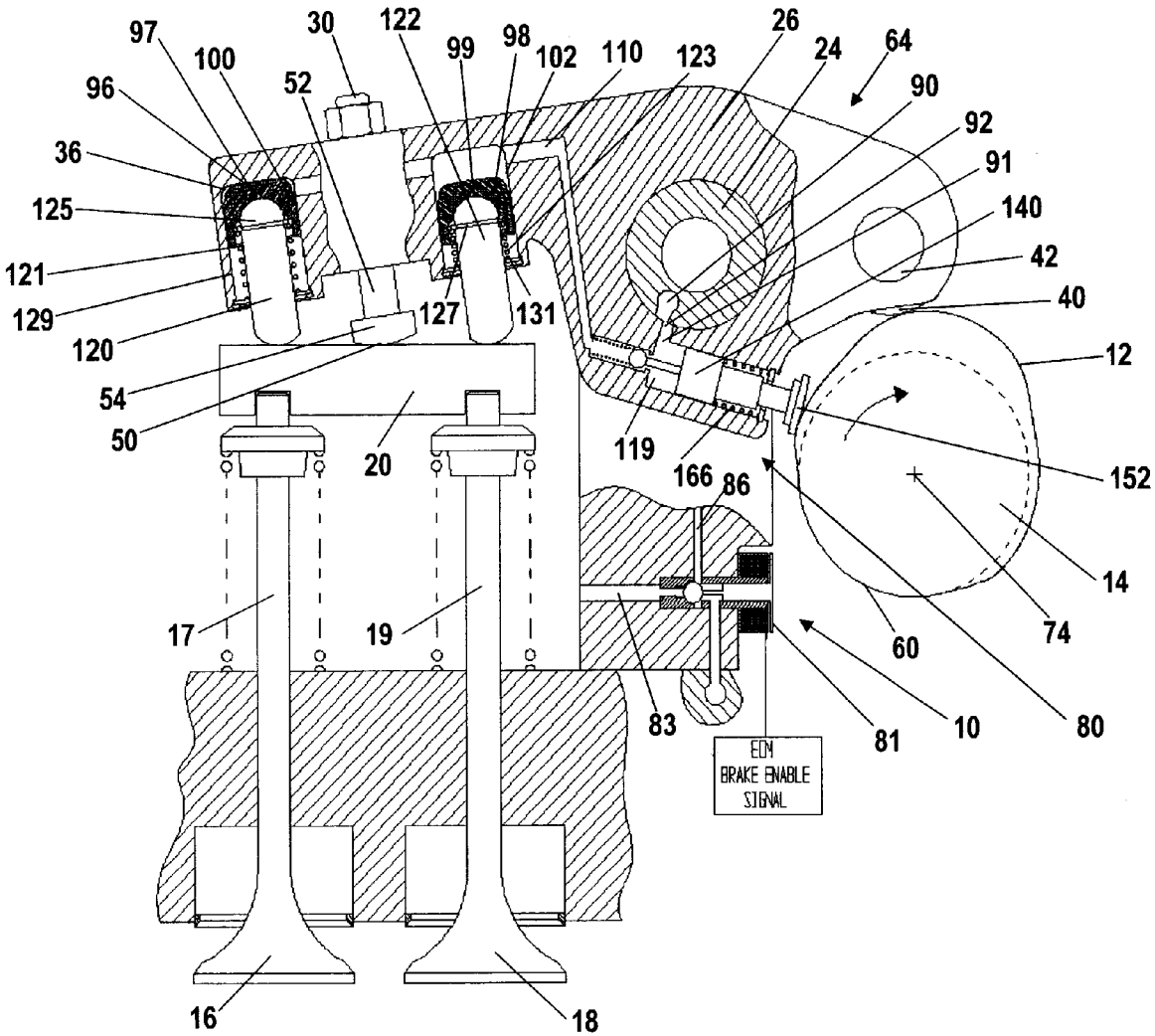
FIG. 4 is a view similar to FIG. 3 with the first lobe of the cam at the position for maximum movement of the mechanism.
Figure 5:
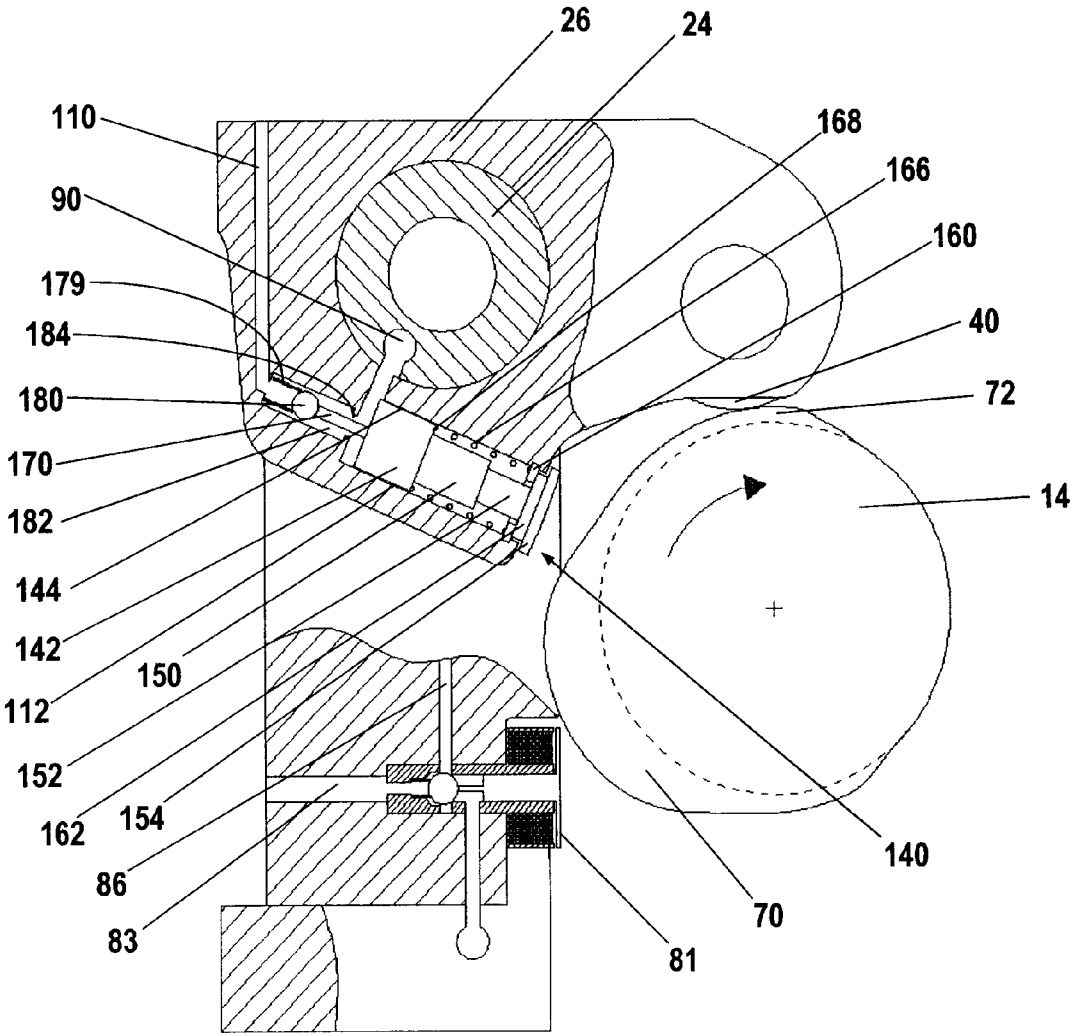
FIG. 5 is an enlarged fragmentary view of the camshaft and mechanism in the position of FIG. 1.

Engine 10 is however provided with a unique valve control apparatus 64 which is integrated with the rocker arm 26. The apparatus is actuated by first raised portion 70 and second raised portion 72 on the camshaft. These raised portions are angularly spaced-apart about axis of rotation 74 of the camshaft. In this example raised portion 70 is a cam lobe and raised portion 72 is on the lower base circle of the cam but other configurations would work as well. The first raised portion 70 extends further from the axis of rotation than the second raised portion. The first raised portion 70 is conventional for all such engines and serves to open the valves 16 and 18 when the raised portion 10 rotates to the position of roller 40. This causes the rocker arm 26 to rotate counter clockwise, from the point of view of FIG. 1, pressing the member 54 onto the crosshead 20 and thereby opening valves 16 and 18 during the exhaust stroke of the engine as seen in FIG. 4. The rocker arm according acts as a follower for the cam and may be referred to as such herein. Alternatively the invention applies to other followers besides rocker arms. The second raised portion 72 is less conventional, but is found in some prior art engines and is used to crack open the valves the second time during each rotation of the camshaft. Typically this is used to crack open the valves near top dead center of the compression stroke to serve as part of a compression release brake for the engine. In this example the second lobe is on the lower base circle of the cam at a position rotated clockwise from lobe 70.

During normal engine operation it is desirable to have the exhaust valves 16 and 18 open only once during each engine cycle, that is during the exhaust stroke when the valves normally open to allow purging of exhaust gases from the cylinder having the valves 16 and 18. The second raised portion 72 should have no effect on the exhaust valves during such normal engine operation. This is achieved in the illustrated embodiment by the clearance 50 between the bottom of the member 54 and the crosshead 20 shown in FIG. 1. The second raised portion 72 extends a smaller distance outwardly from the sub base circle 60. For example, the raised portion 72 in one example extends 0.08 inches further from the axis of rotation 74 than the sub base circle 60. The clearance at 50 is 0.10 inches in this example. The lever arm between the center of the rocker arm shaft and the adjustment screw 30 is longer than the lever arm between the center of the rocker arm shaft and the point of contact between the roller 40 and the camshaft, but this difference is not sufficient for the raised portion 72 to open the valves because clearance 50 is too great during normal engine operation.

The engine 10 however has a mechanism shown generally at 80 for selectively changing operative clearance between the follower and at least one of the camshaft and the valve. The mechanism selectively reduces the clearance on each revolution of the camshaft after the valve is open by the first raised portion 70. The follower operatively engages the second raised portion 72 and opens the valve a second time on each revolution of the camshaft. This operation occurs when the compression release brake is operational.

The compression release brake is provided with a solenoid actuated valve 81, as is conventional for many such units. This valve is located on a hydraulic line 86 which extends to conduit 90 along the rocker arm shaft 24 to a point 92 where it communicates with a conduit 91 in the rocker arm as shown in FIGS. 5–8.

A pair of pistons 96 and 98, shown in FIG. 1–4, are slidingly received in a pair of cylinders 100 and 102 in end 36 of the rocker arm above the valves 16 and 18. In this example the pistons are disposed on opposite sides of the adjustment screw 30. In alternative embodiments a single piston could be substituted or an additional piston added and the positions of the pistons could be altered.

The pistons have recesses 97 and 99 respectively which receive a pair of finger-like members 120 and 122. These are biased upwardly by coil springs 121 and 123 compressed between split washers 125 and 127 on the members and split washers 129 and 131 at the bottoms of the cylinders.

There is a hydraulic conduit 110 which connects the cylinders to the hydraulic conduit 90 through a cylindrical chamber 119 in the rocker arm as seen in FIGS. 5–8. In a first operational mode, when the compression release brake is not operational, the solenoid valve 81 is closed and the pistons 96 and 98 and members 120 and 122 have no effect on opening the valves. Valve 81 is a three-way solenoid which is open to atmosphere through conduit 83 when off and open to oil pressure when on.

The engine is provided with a mechanism for selectively putting the follower (or rocker arm) in a second operational mode where the second raised portion 72 operatively engages the rocker arm to open the valves 16 and 18 a second time on each revolution of the camshaft. This mechanism includes a piston member 142, shown in FIG. 5, which slidingly received in the chamber 112. There is a coil spring 166 compressed between the washer 160 and shoulder 168 of the piston member.

A stem 170 extends from the end of the piston member opposite the camshaft. It contacts a ball 180 of a check valve 182. In the position shown in FIGS. 1 and 5, when the engine brake is not operational, the ball is unseated. There is a spring 179 which biases the ball towards the seat, but normally this is overpowered by spring 166 which is larger and stronger.

Figure 3:
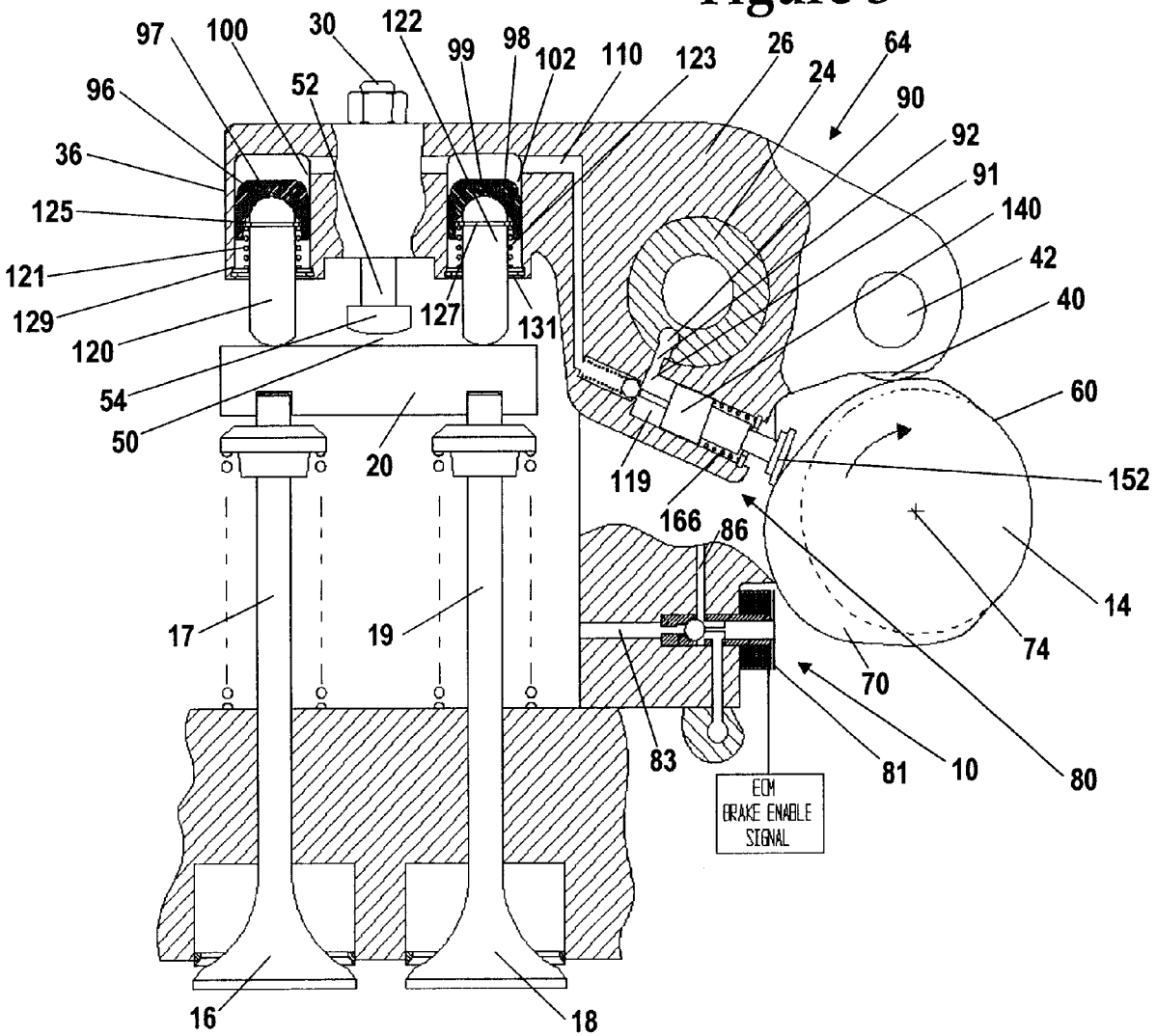
FIG. 3 is a view similar to FIG. 1, with the compression release brake operational.
Figure 7:
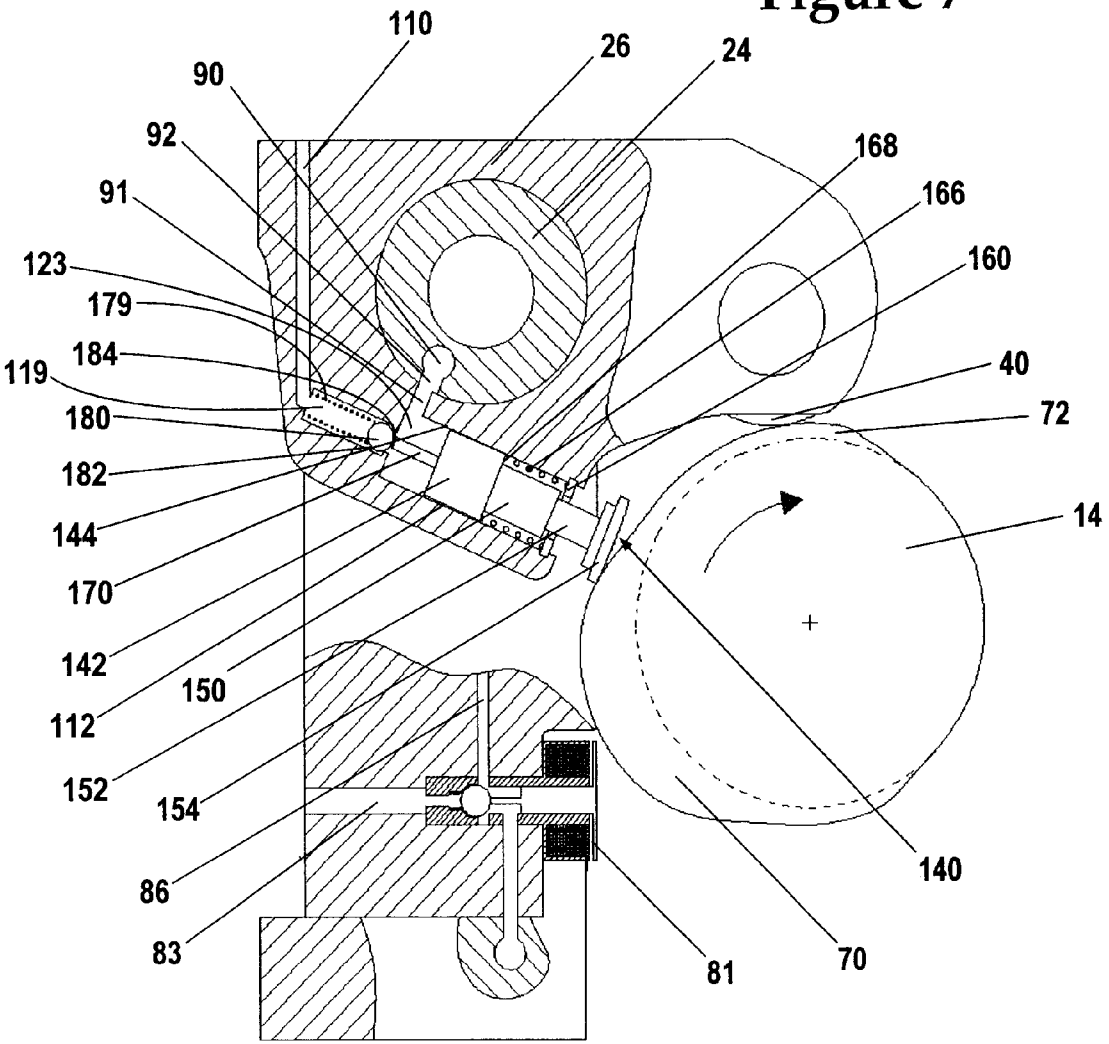
FIG. 7 is a view similar to FIG. 5 shown in the position of FIG. 3.

Referring to FIGS. 3 and 7, when the engine brake is operational, solenoid 81 is opened and pressurized oil is supplied to chamber 119 at the left end of the piston member, from the point of view of the drawings, which pushes the piston member 140 to the right against the pressure of spring 166. The effect is to move stem 170 to the right, from the point of view of the drawings, allowing spring 179 to seat ball 180 on seat 184. This traps oil in conduit 110 extending from the check valve to the cylinders 100 and 102. Thus, when the rocker arm rotates counter clockwise, from the point of view of the drawings, as the raised portion 72 approaches the roller 40, the pistons 96 and 98, shown in FIG. 5, cause members 120 and 122 to contract on the crosshead 20 and crack open the valves a second time near top dead center of the compression stroke.

A problem with some prior art apparatuses of this type is that this taking up of the clearance between the rocker arm and crosshead continues as long as the compression release brake is operational. For example, if this were true in the above the embodiment, then the pistons 96 and 98 and members 120 and 122 would open the valves 16 in 18 when the raised portion 70 reaches the position of the roller 40 for normal opening of the exhaust valves during the exhaust stroke. This is undesirable because it does away with the clearance 50 between the adjustment screw and the crosshead as shown in FIG. 1. This has been undesirable effects on valve timing.

In order to do away with such potential adverse effects on normal exhaust valve opening during the exhaust stroke, the invention includes a trigger device 140 which increases the clearance between the rocker arm and the valves on each revolution of the camshaft after the valves are opened by the raised portion 72 and before they are opened by the raised portion 70.

In this embodiment the trigger device 140, shown in FIGS. 5–8, includes a projection 150 extending towards cam 14. A narrower projection 152 extends from projection 150 and has a disk 154 located exterior to the rocker arm 26. The projection 152 extends slidingly through spring washer 160. The coil spring 166 is compressed between the washer and shoulder 168 of the piston member, biasing the piston member to the left from the point of view of FIG. 5.

Figure 8:
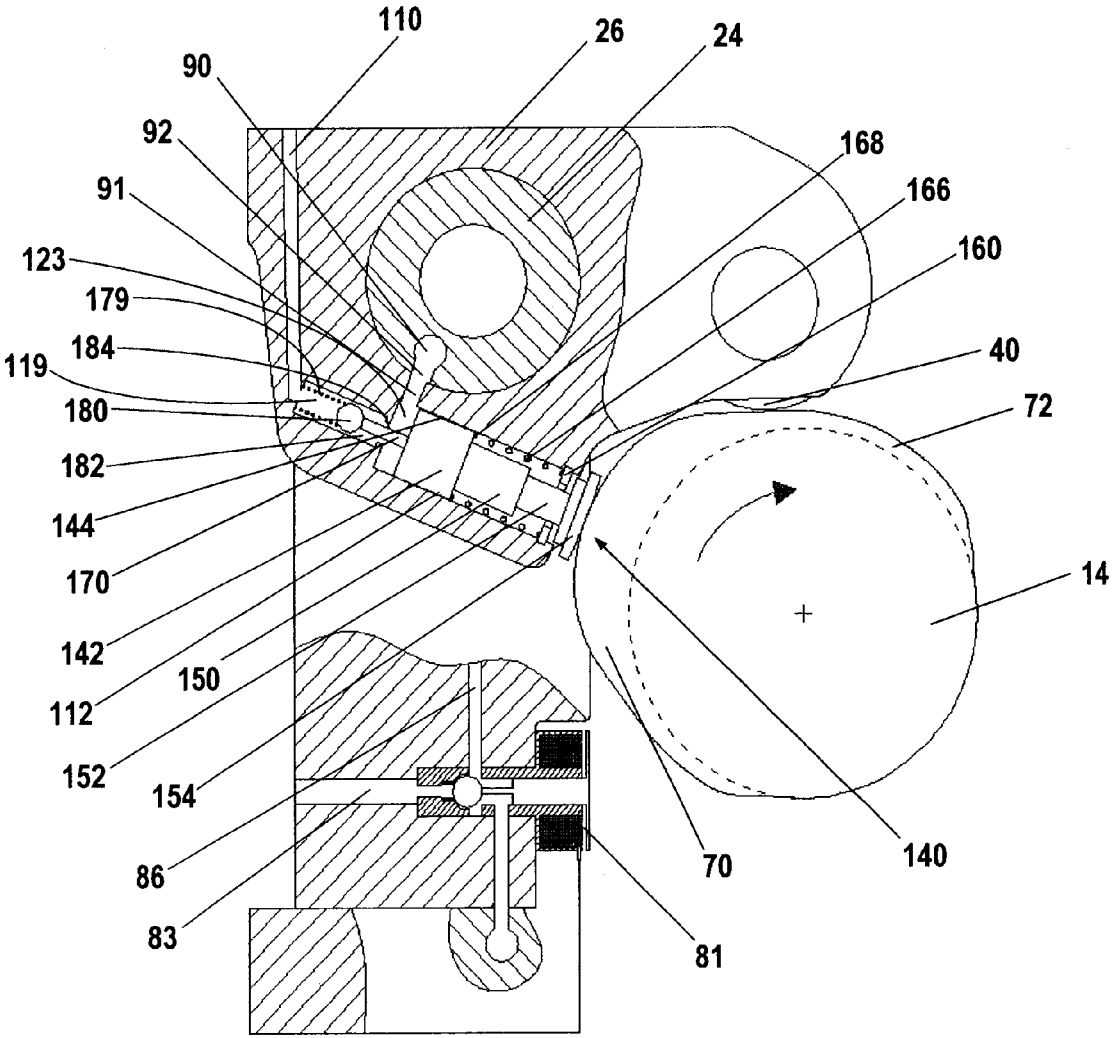
FIG. 8 is a view similar to FIG. 5 with the second raised portion moving away from the roller of the rocket arm.

When the raised portion 70 of the cam approaches the disk 154 in this extended position, as seen in FIG. 7, the disk will contact the lobe when the cam rotates slightly further. When the camshaft is rotated further still the lobe 70 fully engages the disk as seen in FIG. 8, the piston member 142 is pushed to the left, from the point of view of the drawings, causing stem 170 to unseat ball 180 of the check valve 182. This again allows communication hydraulically between conduits 110 and 90. When the members 120 and 122 contact crosshead 20, the pistons 96 and 98 simply move upwardly as seen in FIG. 4, and expel hydraulic fluid through the hydraulic conduits 110 and 90 and the solenoid valve 81, so the pistons do not affect opening of the valves.

The valves 16 and 18 do not open until crosshead 20 contacts the crosshead 20 after the clearance 50 has been taken up. Normal valve operation is therefore not affected for the valve opening during the exhaust stroke.

Figure 6:
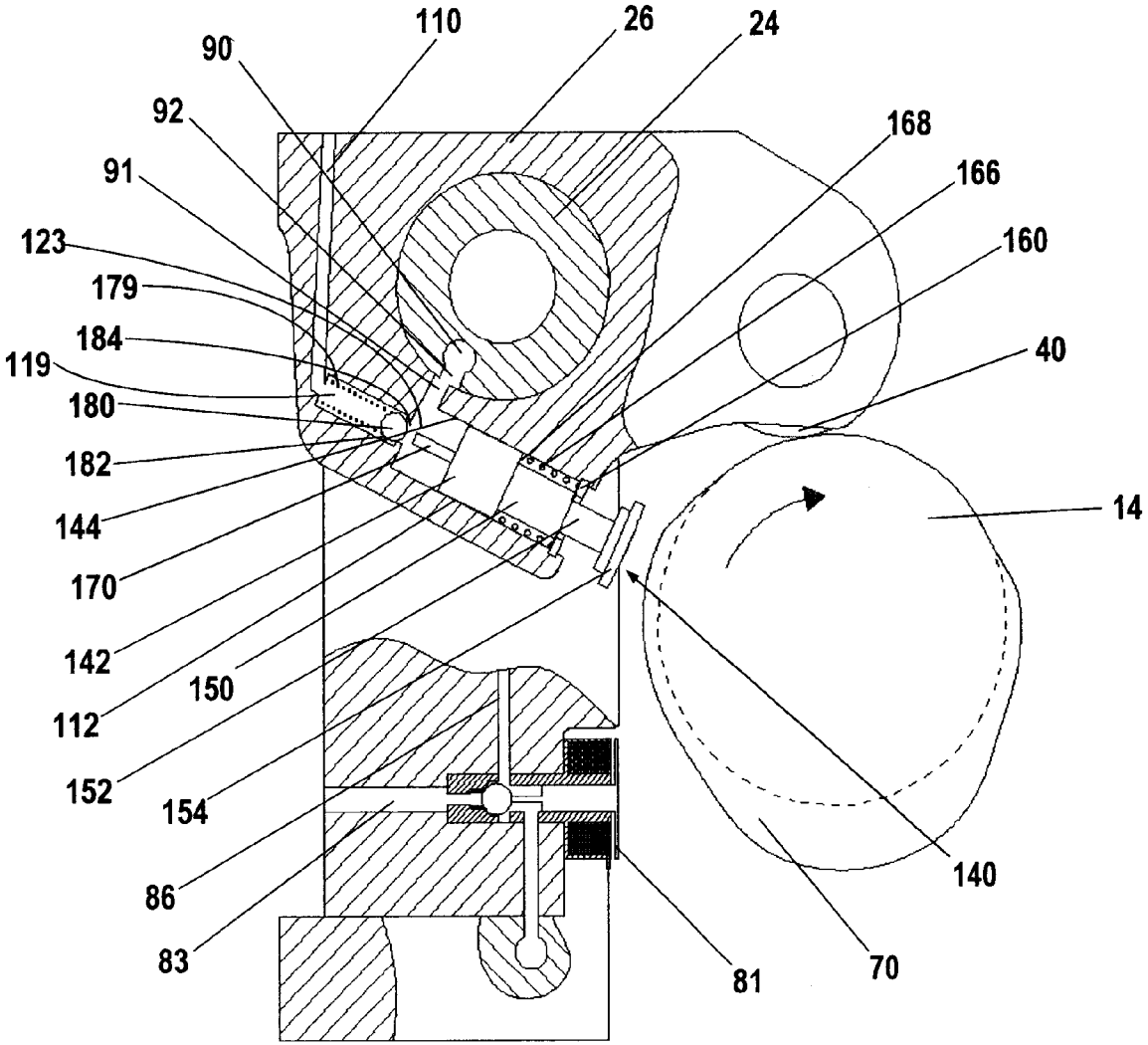
FIG. 6 is a view similar to FIG. 5 shown in the position of FIG. 2.

When the lobe 70 moves away from the roller 40 and reaches the sub base circle again, the camshaft no longer presses on disk 154 and the mechanism resumes the position shown in FIGS. 2 and 6. Thus the valves will be cracked open again near top dead center of the compression stroke while the engine brake is operational.

An alternative embodiment is shown in FIGS. 9–16. In this example the rocker arm assembly has a first operational mode where the exhaust valve is opened on each revolution of the camshaft for normal valve opening during the exhaust stroke. The rocker arm assembly includes a mechanism which selectively puts the assembly in a second operational mode where the valve is opened a second time on each revolution of the camshaft, in this case near top dead center of the compression stroke for engine brake operation. There is also a device which returns the assembly to the first operational mode before the valves are fully open for the normal exhaust stroke. In this embodiment the device is triggered by relative movement between a portion of the rocker arm assembly and the valve.

Referring to the drawings, rocker arm assembly 200 includes a rocker arm 202 which is rotatable about a rocker arm shaft 204. There is a roller 206 rotatable about a shaft 208 at one end of the rocker arm. This roller contacts camshaft 210 which is rotatable about axis 212.

FIGS. 10–16 show a fragment of a diesel engine 214 including a pair of exhaust valves 216 and 218 for one of the engine cylinders. There is a crosshead 220 operatively connecting the valves and permitting the valves to be opened simultaneously as is conventional. The rocker arm assembly includes a first member 222 which contacts the crosshead and opens the exhaust valves when the rocker arm assembly is rotated by the camshaft for normal valve opening during the exhaust stroke.

Rocker arm assembly 200 however is different from convention rocker arm assemblies in several respects. It has for example a second member 224 which operatively contacts exhaust valve 218 to selectively crack open exhaust valve 218. In this embodiment this occurs during operation of a compression release brake when the valve 218 is cracked open near top dead center of the compression stroke. The member 224 is mounted on a hydraulic actuator 226 which extends or retracts the member according to the appropriate mode of operation. The first member 222 is connected to a hydraulic valve 228 which controls the flow of fluid to and from the actuator 226.

There is a cylindrical member 230 mounted on top of valve 218 which extends through aperture 232 in the crosshead 220. The aperture in the crosshead has a larger diameter lower portion 234 and a smaller diameter upper portion 236 and the member 230 has a shoulder 238. The shoulder 238 contacts the crosshead just below the smaller diameter portion 236 to limit relative upward movement of the member 230 with respect to the crosshead. However the member is slidable downwards through the aperture from the position shown in FIG. 10.

Figure 9:
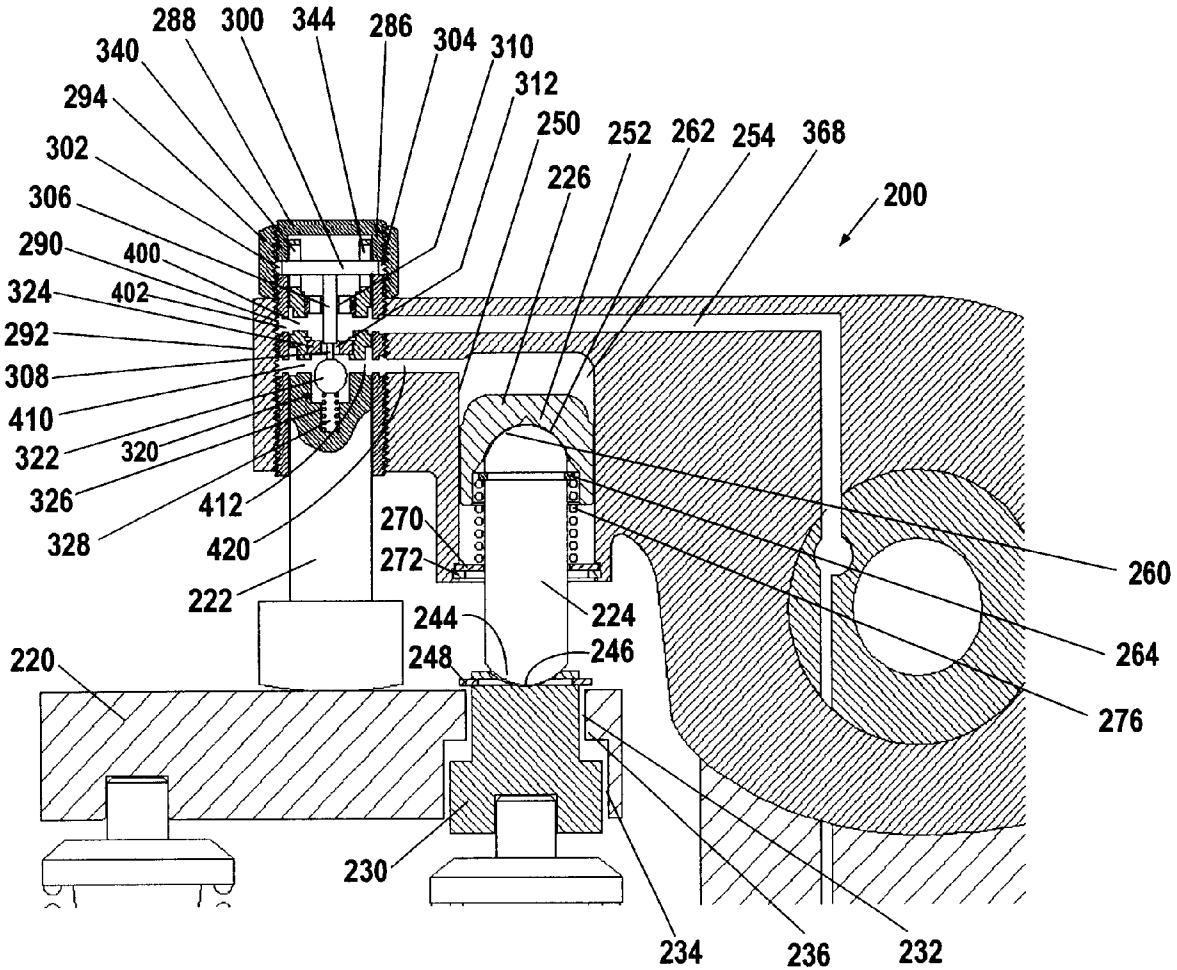
FIG. 9 is an enlarged, fragmentary sectional view of a valve control apparatus according to an alternative embodiment of the apparatus, showing a fragment of the rocker arm assembly including the first member for opening the exhaust valves on the exhaust stroke, the hydraulic valve connected thereto and the second member for selectively opening one of the exhaust valves near top dead center of the compression stroke together with the hydraulic actuator connected thereto.

Referring to FIG. 9, the second member 224 has a rounded outer end 244 which, when the member is extended, fits within recess 246 of the member 230. A snap ring 248 is connected to the top of the member 230 to limit its downward movement through the aperture 232.

The actuator 226 includes a cylinder 250 in the rocker arm assembly and a piston 252 reciprocatingly received in the cylinder. A hydraulic chamber 254 is provided above the piston. The member 224 has a rounded top 260 which fits within rounded recess 262 inside the piston. A snap ring 264 is fitted about the member 224 near the top thereof. A washer 270, retained by a snap ring 272, is fitted near the lower, outer end of the cylinder 250. A coil spring 276 is compressed between the snap rings 264 and 270, thereby biasing the member 224 and piston 226 upwards from the point of view of FIG. 9.

Member 22 is slidable within bore 286 in a hollow, male threaded member 288. This member is threadedly received within a corresponding female threaded bore 290 extending through the rocker arm near end 292 thereof which is opposite the camshaft. A lock nut 294 is threadedly received at the upper end of the member 288 to secure it in a desired position within the threaded bore in the rocker arm.

There is a pin 300 extending across the inside of the hollow member 288 and through apertures 302 and 304 on diametrically opposite sides thereof. A second pin 306, perpendicular to pin 300, extends downwardly from the pin 300 and has a smaller diameter outer portion 308 at the bottom end thereof.

The valve spool 280 has an axial aperture 310 which is slidably received over the pin 306 and thereby permits relative sliding of the valve spool along the pin. The valve spool also has a second axial aperture 312. The lower end of the pin 306 passes through this second aperture in the valve spool.

There is a check valve 320 including a ball 322 and a valve seat 324 on the valve spool adjacent the lower end of aperture 312. Ball 322 is biased upwardly by coil spring 326 located in socket 328 near the bottom end of the valve spool.

The valve spool has elongated slots 340 and 344 on opposite sides thereof. The pin 300 extends through these elongated slots, thereby allowing movement of the spool relative to the pin while the pin limits upward and downward movement of the valve spool.

Figure 10:
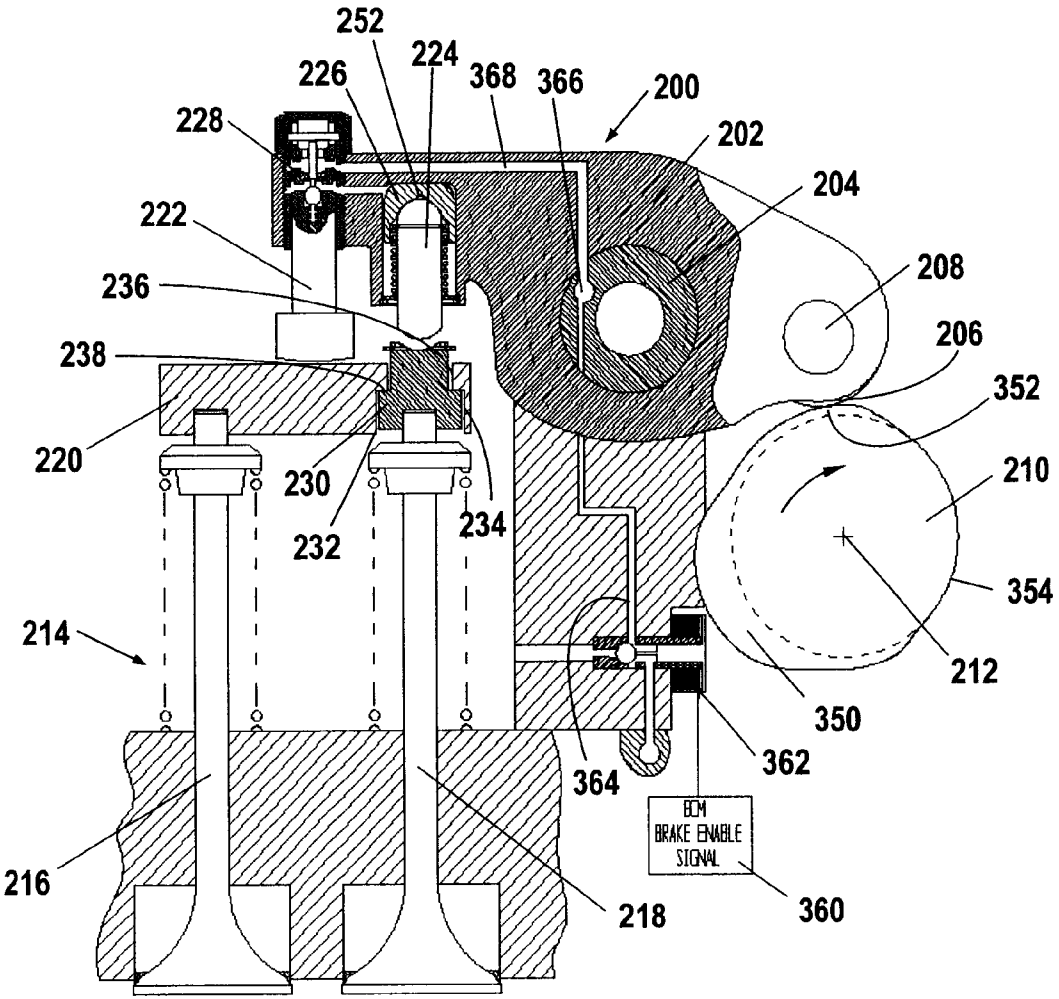
FIG. 10 is a side sectional view of the embodiment of FIG. 9 showing a fragment of the engine including two exhaust valves, the apparatus being shown in a position when the compression release brake is off and the roller on the rocker arm is on the lower base circle of the camshaft.

With reference to FIG. 10, like the previous embodiments camshaft 210 has a first raised portion 350 and a second raised portion 352. The second raised portion in this example is on the portion of the cam commonly referred to as the lower base circle. This portion is a raised portion with respect to the sub base circle 354.

The engine brake is controlled by an electronic control module (ECM) 360 which is operatively connected to solenoid valve 362. Pressurized oil is supplied from the valve to the actuator 226 through passageway 364 in the head of the engine, passageway 366 in the rocker arm shaft and passageway 368 in the rocker arm. Referring to FIG. 9, oil from the passageway can flow through aperture 400 in member 288 and aperture 402 in the valve spool to the center of the valve spool. Here it can flow downwardly through aperture 312 and past the check valve 320 to enter chamber 254 through apertures 410 and 412 in the valve spool and member 288 respectively and passageway 420 in the rocker arm. A return flow of oil from the chamber 254 is possible when the check valve 320 is opened as shown in FIG. 9. However, when the check valve is closed, as described below, hydraulic fluid is prevented from flowing outwardly from the chamber.

Referring to FIG. 10, this shows the apparatus when the brake is not operational. The member 224 is retracted along with piston 252 since pressurized oil is not supplied to the actuator. The roller 206 of the rocker arm is shown on the second raised portion 352 of the camshaft. The first member 222 contacts the crosshead. Both valves are closed.

Figure 11:
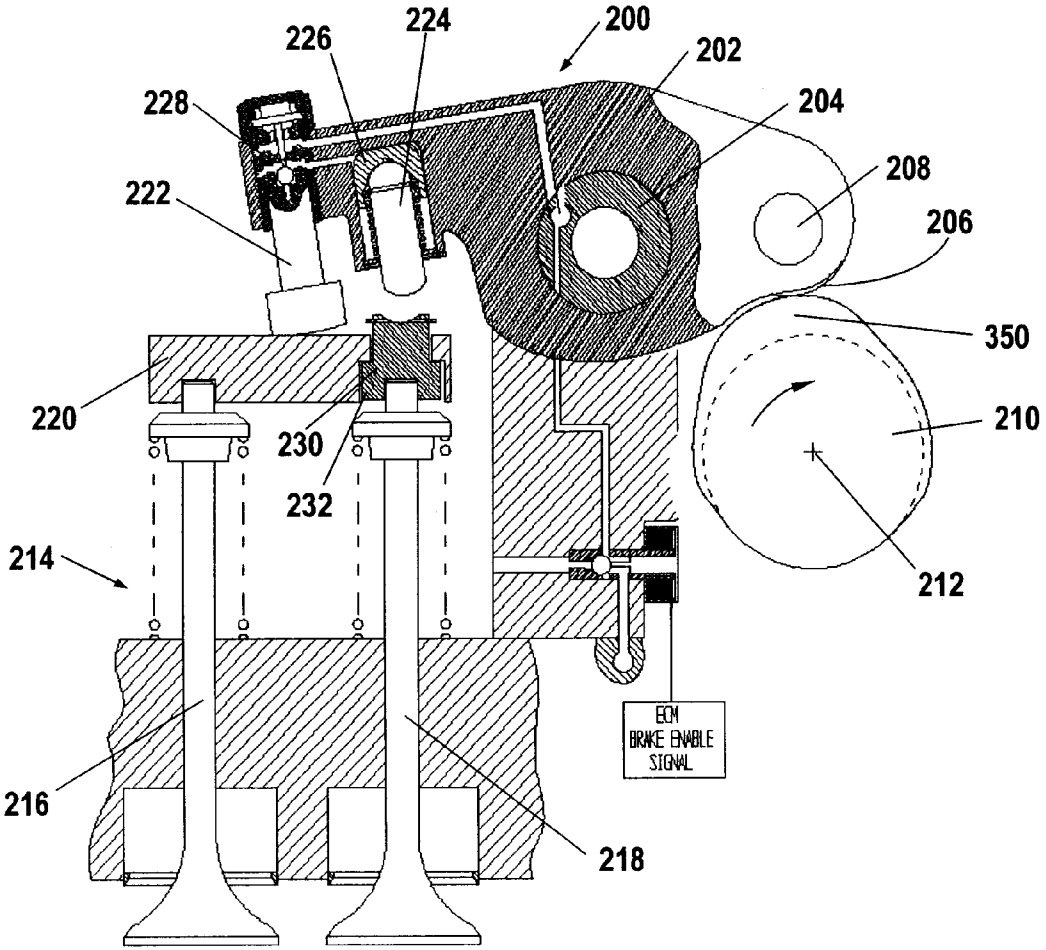
FIG. 11 is a view similar to FIG. 10 showing the position of the apparatus during peak exhaust valve lift when the brake is off.

FIG. 11 shows the operation of the device when the roller 206 is on the high point of the first raised portion 250. The member 222 has depressed the crosshead 220 fully downwards for complete opening of the valves 216 and 218 for the normal exhaust stroke.

Figure 12:
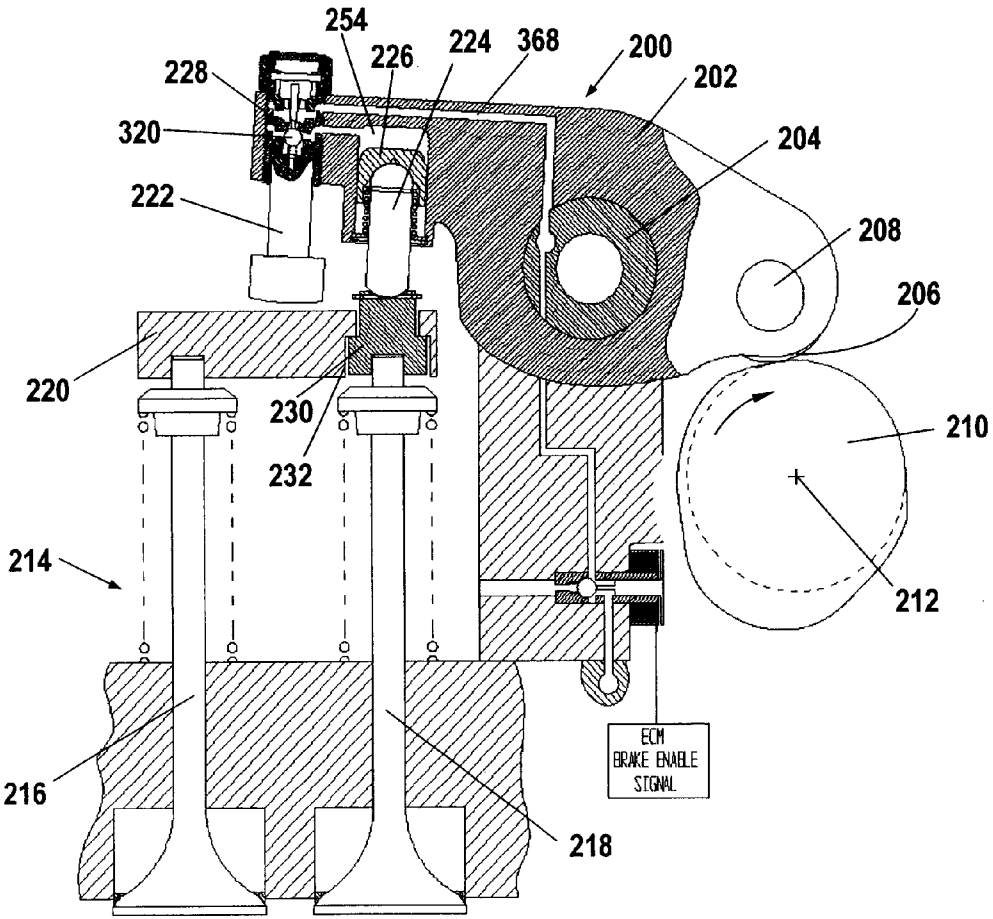
FIG. 12 is a view similar to FIG. 10 in the position when the brake is on and the roller of the rocker arm is on the sub base circle of the camshaft.

FIG. 12 shows the device when the brake is operational and therefore oil is supplied to chamber 254 through passageway 368 and past the check valve 320 as described in more detail above. This causes the piston 226 to move downwardly, extending the second member 224 as shown. As the same time, the pressurized oil from passageway 368 moves the valve spool 222 downwardly relative to pins 300 and 306. This causes ball 322 of the check valve 320, as shown in FIG. 12, to rest against its seat 324 and thereby prevent an outflow of oil from chamber 254.

Figure 13:
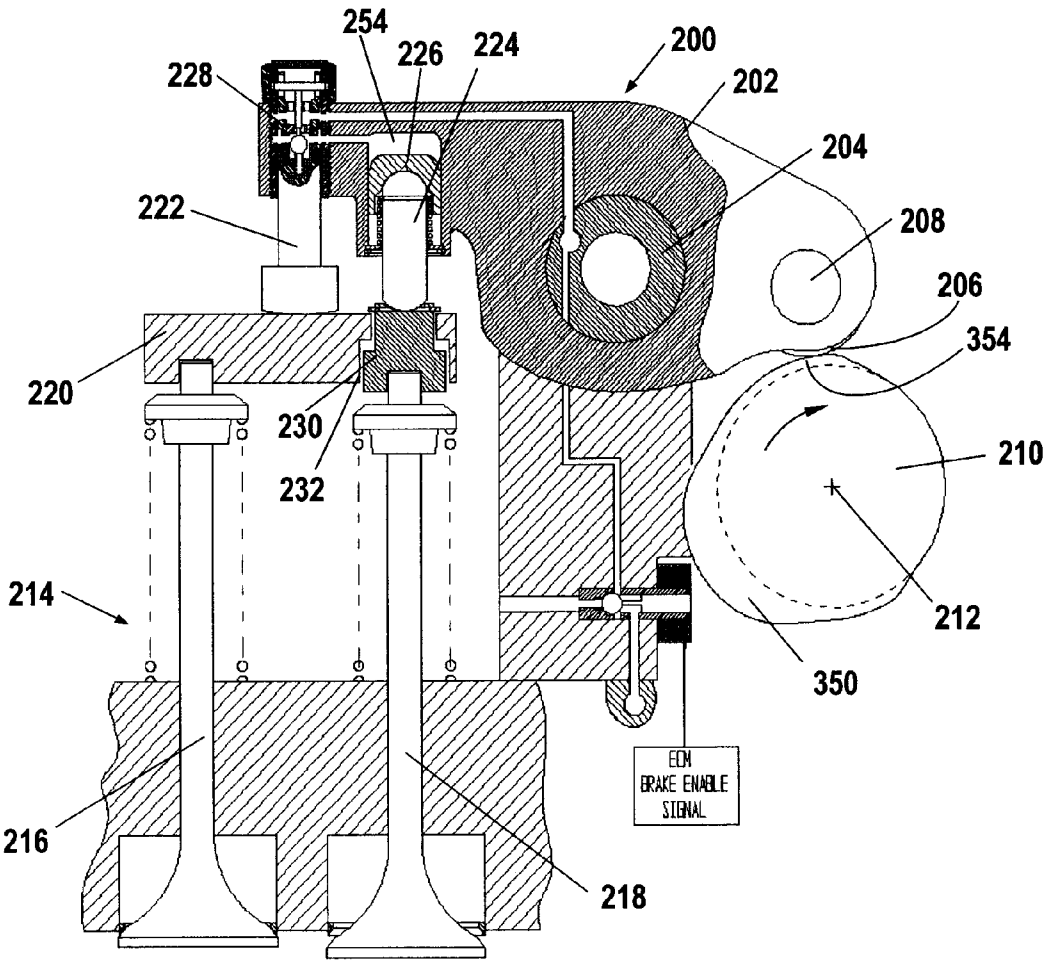
FIG. 13 is a view similar to FIG. 12, showing the position when the brake is on and the roller is on the lower base circle of the camshaft, the second member being extended by the hydraulic actuator and with one of the exhaust valves cracked open, the first member contacting the crosshead and opening the hydraulic valve in the rocker arm assembly to permit retraction of the second member for subsequent normal exhaust valve opening.
Figure 14:
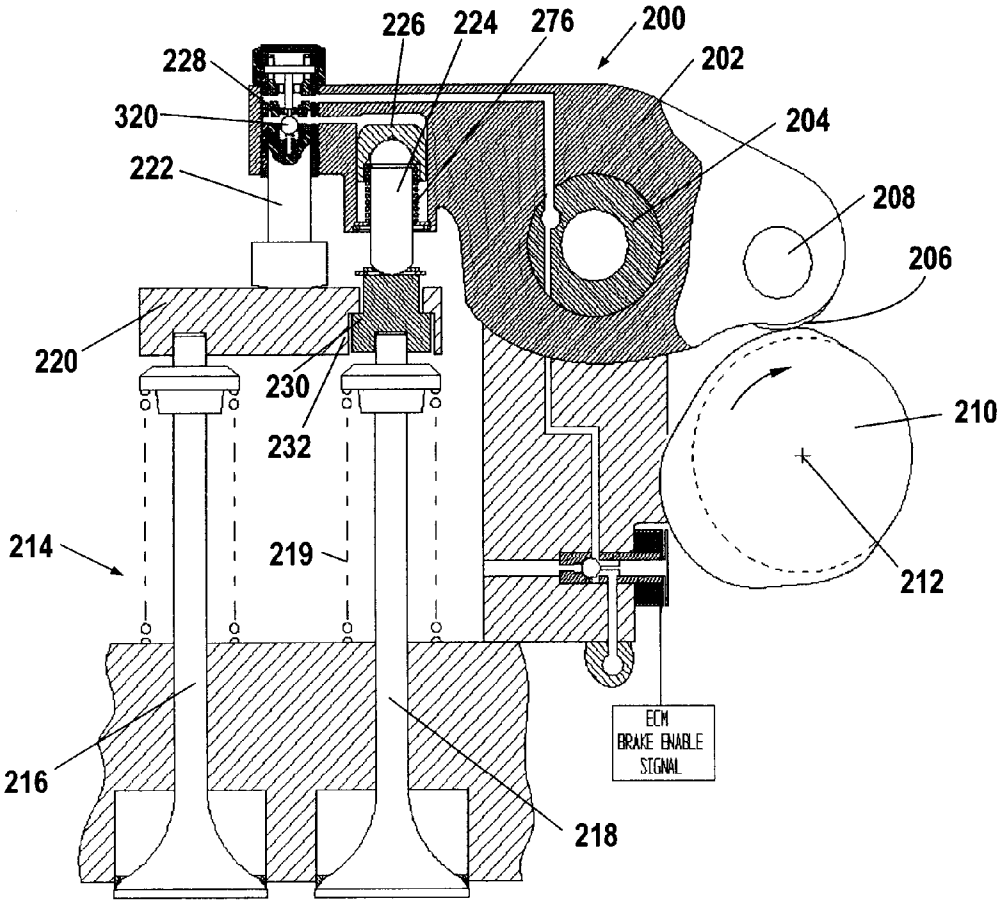
FIG. 14 is a view similar to FIG. 13 showing the hydraulic actuator and second member retracted.
Figure 15:
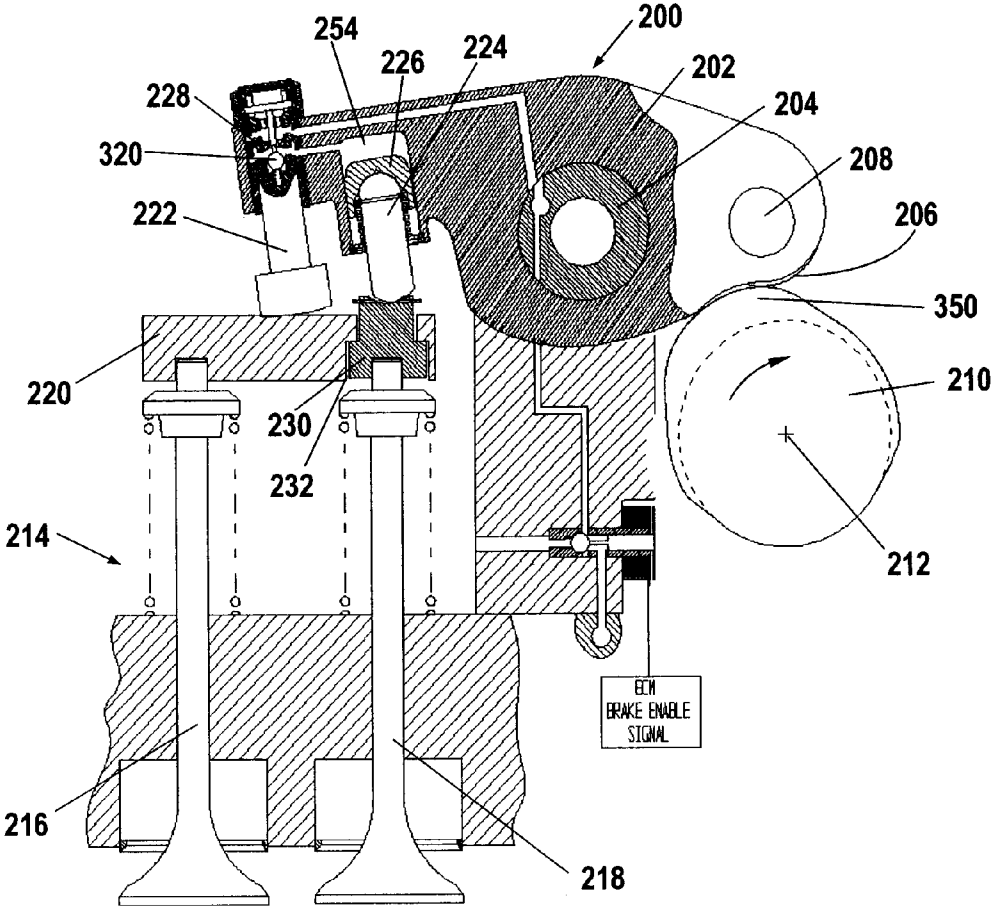
FIG. 15 is a view similar to FIG. 14 showing normal exhaust valve opening with the second member extended.

Referring to FIG. 13, with the oil so locked in the chamber 254, the roller rides up on the second raised portion 354. The member 224 which has been extended downwardly, has pressed against the member 230 and thus has cracked open the valve 218 as shown. This corresponds to the top dead center of the compression stroke and thereby cracks open the exhaust valve 218 for engine brake operation. However, member 222 has been pressed against crosshead 220 which, with reference to FIG. 9, has the effect of pushing valve spool 222 upwardly and thereby opening check valve 320 and permitting a reverse flow of oil from chamber 254. This allows closing of valve 218 due to valve spring 219 and spring 276 acting against piston 226 as shown in FIG. 14.

Thus, when the roller 206 again rides up on raised portion 350 for the normal exhaust stroke, both valves 216 and 218 are opened normally by the first member 222 and member 224 has no effect since the check valve 320 is opened permitting oil to flow outwardly from the chamber 254.

Figure 16:
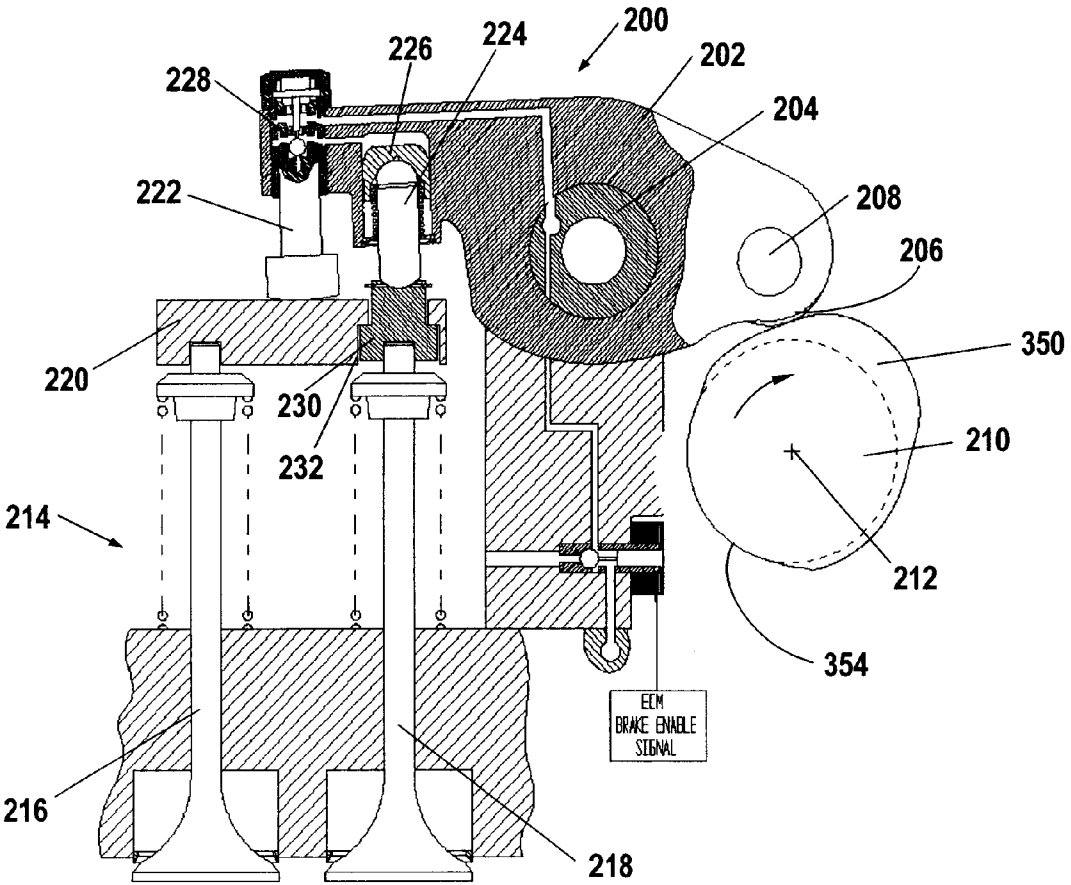
FIG. 16 is a view similar to FIG. 15 showing cam rotating towards the sub base position where the chamber above the hydraulic actuator in the rocker arm assembly is refilled with oil to extend the second member again.

FIG. 16 shows the cam in a position where the roller 206 is approaching the second raised portion 354. The member 222 moves away from the crosshead 220 and, with reference to FIG. 9, with the brake operational, the pressurized oil from passageway 368 forces the valve spool 222 downwardly, again closing the check valve. The oil again is locked in chamber 254 with the member 224 extended and the cycle begins again for the next cracking open of the valve 218 near top dead center of the compression stroke.

It will be understood by someone skilled in the art that many of the details provided above are by way of example only and can be deleted or altered without departing from the scope of the invention as set out in the following claims.

What is claimed is:

1. A valve control apparatus for an internal combustion engine having a valve and a camshaft, the camshaft having an axis of rotation, a first raised portion and a second raised portion, the second raised portion being angularly spaced-apart about the axis from the first raised portion, the apparatus comprising:

a follower operatively engagable with the camshaft and the valve, the follower having a first operational mode where the first raised portion operatively engages the follower on each revolution of the camshaft to open said valve a first time on each revolution on the camshaft and where the second raised portion operatively clears the follower on each revolution of the camshaft without actuating said valve; and a mechanism for selectively putting the follower in a second operational mode where the second raised portion operatively engages the follower to open said valve a second time on each revolution of the camshaft, the mechanism putting the follower in the second operational mode on each revolution of the camshaft before the second raised portion rotates completely to alignment with the follower, the mechanism having a device which returns the follower to the first operational mode after the valve is opened by the second raised portion and before the first raised portion fully opens the valve, whereby maximum opening and normal closing of the valve by the first raised portion is unaffected when the mechanism selectively puts the follower in the second operational mode, the device being triggered by the device being triggered by the first raised portion.

2. An apparatus as claimed in claim 1, wherein the follower is a rocker arm and the first raised portion and the second raised portion are on one cam of the camshaft, the cam having a lower base circle, the second raised portion being on the lower base circle.

3. An apparatus as claimed in claim 1, wherein the valve closes on each revolution of the camshaft after the first raised portion passes the follower.

4. A valve control apparatus for an internal combustion engine having a valve and a camshaft, the camshaft having an axis of rotation, a first raised portion and a second raised portion, the second raised portion being angularly spaced-apart about the axis from the first raised portion, the apparatus comprising:

a follower operatively engagable with the camshaft and the valve, the follower having a first operational mode where the first raised portion operatively engages the follower on each revolution of the camshaft to open said valve a first time on each revolution on the camshaft and where the second raised portion operatively clears the follower on each revolution of the camshaft without actuating said valve; and a mechanism for selectively putting the follower in a second operational mode where the second raised portion operatively engages the follower to open said valve a second time on each revolution of the camshaft, the mechanism putting the follower in the second operational mode on each revolution of the camshaft before the second raised portion rotates completely to alignment with the follower, the mechanism having a device which returns the follower to the first operational mode after the valve is opened by the second raised portion and before the first raised portion fully opens the valve, whereby maximum opening and normal closing of the valve by the first raised portion is unaffected when the mechanism selectively puts the follower in the second operational mode, the device being triggered by the camshaft, the device including a hydraulic piston in a hydraulic cylinder, the piston operatively contacting the valve, a check valve which prevents fluid from exiting the hydraulic cylinder and a member which unseats the check valve when contacted by the first raised portion.

5. An apparatus as claimed in claim 4, wherein said member is slidingly received in a chamber, the hydraulic cylinder communicating hydraulically with the chamber.

6. An apparatus as claimed in claim 4, wherein the engine has a rocker arm shaft which includes passageways to supply fluid to the hydraulic cylinder for the second operational mode and to drain fluid from the hydraulic cylinder for the first operational mode.

7. A valve control apparatus for an internal combustion engine having an exhaust stroke and a compression stroke, an exhaust valve and a camshaft, the camshaft having an axis of rotation, a first raised portion and a second raised portion, the first raised portion being positioned on the camshaft to open the exhaust valve on the exhaust stroke of the engine, the second raised portion being angularly spaced-apart about the axis from the first raised portion, and being positioned on the camshaft to open the exhaust valve near top dead center of the compression stroke, the apparatus functioning as a compression release brake and comprising:

a follower operatively engagable with the camshaft and the valve, the follower having a first operational mode where the first raised portion operatively engages the follower on each revolution of the camshaft to open said valve a first time on each revolution on the camshaft and where the second raised portion operatively clears the follower on each revolution of the camshaft without actuating said valve; and a mechanism for selectively putting the follower in a second operational mode where the second raised portion operatively engages the follower to open said valve a second time on each revolution of the camshaft, the mechanism putting the follower in the second operational mode on each revolution of the camshaft before the second raised portion rotates completely to alignment with the follower, the mechanism having a device which returns the follower to the first operational mode after the valve is opened by the second raised portion and before the first raised portion fully opens the valve, whereby maximum opening and normal closing of the valve by the first raised portion is unaffected when the mechanism selectively puts the follower in the second operational mode, the device being triggered by the camshaft.

8. An internal combustion apparatus comprising:

an engine having a plurality of cylinders, an exhaust stroke and a compression stroke, each said cylinder having an exhaust valve;

a camshaft, the camshaft having an axis of rotation, a first raised portion and a second raised portion, the first raised portion being positioned on the camshaft to open the exhaust valve on the exhaust stroke of the engine, the second raised portion being angularly spaced-apart about the axis from the first raised portion and being positioned on the camshaft to open the exhaust valve near top dead center of the compression stroke, whereby the apparatus functions as a compression release brake, the first raised portion and the second raised portion being on one cam of the camshaft, the one cam having a lower base circle, the second raised portion being on the lower base circle and the first raised portion being a lobe;

a follower operatively engagable with the camshaft and with the valve of said each cylinder, the follower having a first operational mode where the first raised portion operatively engages the follower on each revolution of the camshaft to open said valve a first time and where the second raised portion operatively clears the follower on each revolution of the camshaft without actuating said valve; and a mechanism for selectively putting the follower in a second operational mode where the second raised portion operatively engages the follower to open said valve a second time on each revolution of the camshaft, the mechanism putting the follower in the second operational mode on each revolution of the camshaft before the second raised portion is fully aligned with the follower, the mechanism having a hydraulic device for returning the follower to the first operational mode after the valve is opened by the second raised portion and before the first raised portion fully operatively engages the follower, whereby maximum opening and normal closing of the valve by the first raised portion is unaffected when the mechanism selectively puts the follower in the second operational mode, the device being triggered by the camshaft, said device including a chamber for hydraulic fluid, said chamber being closed and full of hydraulic fluid in one said operational mode and being opened to allow a discharge of said hydraulic fluid in another said operational mode.

9. An apparatus as claimed in claim 8, wherein the follower is a rocker arm mounted on a rocker arm shaft.

10. An apparatus as claimed in claim 9, including passageways in the rocker arm shaft for supplying hydraulic fluid to the chamber for the second operational mode and for draining hydraulic fluid from the chamber for the first operational mode.

11. An apparatus as claimed in claim 8, wherein the valve closes on each revolution of the camshaft after the first raised portion passes the follower.

12. An apparatus as claimed in claim 8, wherein said one mode is the second operational mode and said another mode is the first operational mode.

13. A method of controling wave actuation for an internal combustion engine having an exhaust valve and a camshaft, the method comprising the steps of:

providing a mechanism operatively connecting the valve and the camshaft;

providing two raised portions on the camshaft for said valve, a first said raised portion operatively engaging the mechanism to open the valve a first time on each revolution of the camshaft on the exhaust stroke of the engine;

selectively adjusting the mechanism a first time on each revolution of the camshaft after the first raised portion passes the mechanism so the mechanism engages a second said raised portion to selectively open the valve a second time on each revolution of the camshaft near top center of the compression stroke, thereby acting as a compression release brake, and adjusting the mechanism a second time on each revolution of the camshaft after the second raised portion opens the valve so the maximum opening and normal closing of the valve by the first raised portion is unaffected after the mechanism is selectively adjusted the first time, the mechanism being adjusted the second time by a device which contacts the camshaft.

14. A method as claimed in claim 13, wherein the valve closes after the first raised portion passes the mechanism.

15. A valve control apparatus for an internal combustion engine having an exhaust valve and a camshaft, the camshaft having an axis of rotation, a first raised portion and a second raised portion, the second raised portion being angularly spaced-apart about the axis from the first raised portion, the apparatus comprising:

a rocker arm assembly operatively engagable with the camshaft and the valve, the assembly having a first operational mode where the first raised portion operatively engages the follower on each revolution of the camshaft to open said valve a first time on each revolution on the camshaft and where the second raised portion operatively clears the assembly on each revolution of the camshaft without actuating said valve, the assembly including a mechanism for selectively putting the assembly in a second operational mode where the second raised portion operatively engages the follower to open said valve a second time on each revolution of the camshaft, the mechanism putting the assembly in the second operational mode on each revolution of the camshaft before the second raised portion rotates completely to alignment with the follower, the mechanism having a device which returns the assembly to the first operational mode after the valve is opened by the second raised portion and before the first raised portion fully opens the valve, whereby maximum opening and normal closing of the valve by the first raised portion is unaffected when the mechanism selectively puts the follower in the second operational mode, the device being triggered by relative movement between a portion of the rocker arm assembly and the valve.

16. A valve control apparatus as claimed in claim 15, wherein the rocker arm assembly includes a first member operatively contacting the exhaust valve to open the exhaust valve the first time on each revolution of the camshaft and a second member operatively contacting the exhaust valve to selectively open the exhaust valve the second time on each revolution of the camshaft the device being triggered by movement of the first member when the first member operatively contacts the exhaust valve.

17. A valve control apparatus as claimed in claim 16, wherein the rocker arm assembly includes a hydraulic actuator and a hydraulic valve, the first member being operatively coupled to the hydraulic valve and the second member being operatively coupled to the actuator, the actuator extending the second member during the second operational mode so the second member operatively contacts the exhaust valve and opens the exhaust valve during each rotation of the camshaft during the second operational mode, the first member releasing hydraulic fluid from the actuator to retract the second member before the first raised portion fully opens the exhaust valve with the first member.

18. A valve control apparatus as claimed in claim 17, including means for supplying hydraulic fluid to the hydraulic actuator during the second operational mode to extend the second member.

19. A valve control apparatus as claimed in claim 15, wherein the first raised portion and the second raise portion are on one cam of the camshaft, the one cam having a lower base circle, the second raised portion being on the lower base circle, the first raised portion being a lobe.

20. An internal combustion apparatus comprising:

an engine having a plurality of cylinders, each said cylinder having an exhaust valve;

a camshaft, the camshaft having an axis of rotation, a first raised portion and a second raised portion, the second raised portion being angularly spaced-apart about the axis from the first raised portion;

a rocker arm operatively engagable with the camshaft and with the valve of said each cylinder, the rocker arm having a first operational mode where the first raised portion operatively engages the rocker arm on each revolution of the camshaft to open said valve a first time and where the second raised portion operatively clears the follower on each revolution of the camshaft without actuating said valve; and a mechanism for selectively putting the rocker arm in a second operational mode where the second raised portion operatively engages the rocker arm to open said valve a second time on each revolution of the camshaft, the mechanism putting the rocker arm in the second operational mode on each revolution of the camshaft before the second raised portion is fully aligned with the rocker arm, the mechanism having a device for returning the rocker arm to the first operational mode after the valve is opened by the second raised portion and before the first raised portion fully operatively engages the rocker arm, whereby maximum opening and normal closing of the valve by the first raised portion is unaffected when the mechanism selectively puts the rocker arm in the second operational mode, the device being triggered by the relative movement between a portion of the rocker arm assembly and the valve.

21. An apparatus as claimed in claim 20, wherein the rocker arm assembly includes a hydraulic actuator and a hydraulic valve, the first member being operatively coupled to the hydraulic valve and the second member being operatively coupled to the actuator, the actuator extending the second member during the second operational mode so the second member operatively contacts the exhaust valve and opens the exhaust valve during each rotation of the camshaft during the second operational mode, the first member releasing hydraulic fluid from the actuator to retract the second member before the first raised portion fully opens the exhaust valve with the first member.

22. An apparatus as claimed in claim 21, including means for supplying hydraulic fluid to the hydraulic actuator during the second operational mode to extend the second member.

23. An apparatus as claimed in claim 20, the first raised portion and the second raised portion being on one cam of the camshaft, the one cam having a lower base circle, the second raised portion being on the lower base circle, the first raised portion being a lobe.

24. A method of controlling valve actuation for an internal combustion engine having a valve and a camshaft, the method comprising the steps of:

providing a mechanism operatively connecting the valve and the camshaft; providing two raised portions on the camshaft for said valve, a first said raised portion operatively engaging the mechanism to open the valve a first time on each revolution of the camshaft;

selectively adjusting the mechanism a first time on each revolution of the camshaft after the first raised portion passes the mechanism so the mechanism engages a second said raised portion to open the valve a second time on each revolution of the camshaft, and adjusting the mechanism a second time on each revolution of the camshaft after the second raised portion opens the valve so the maximum opening and normal closing of the valve by the first raised portion is unaffected after the mechanism is selectively adjusted the first time, the mechanism being adjusted the second time by relative movement between a portion of the rocker arm assembly and the valve.

25. A method as claimed in claim 24, wherein the valve is an exhaust valve, the first raised portion opening the valve on the exhaust stroke of the engine and the second raised portion selectively opening the valve near top dead center of the compression stroke, thereby acting as a compression release brake.

26. A method as claimed in claim 24, wherein the valve closes after the first raised portion passes the mechanism.

* * * * *